US009332328B2

(12) United States Patent
Wu

(10) Patent No.: US 9,332,328 B2
(45) Date of Patent: May 3, 2016

(54) MAGNETIC YOKE USED FOR A MOVING-IRON MICROPHONE/TRANSDUCER

(75) Inventor: Zhe Wu, Jiangsu (CN)

(73) Assignee: Suzhou Shinwu Optronics Technology Co., Ltd, Suzhou (CN)

( * ) Notice: Subject to any disclaimer, the term of this patent is extended or adjusted under 35 U.S.C. 154(b) by 0 days.

(21) Appl. No.: 14/233,338

(22) PCT Filed: Nov. 14, 2011

(86) PCT No.: PCT/CN2011/082135

§ 371 (c)(1),
(2), (4) Date: Jan. 16, 2014

(87) PCT Pub. No.: WO2013/044551

PCT Pub. Date: Apr. 4, 2013

(65) Prior Publication Data

US 2014/0153749 A1 Jun. 5, 2014

(30) Foreign Application Priority Data

Sep. 27, 2011 (CN) ..... 2011 1 0289178

(51) Int. Cl.

| | |
|---|---|
| ***H04R 25/00*** | (2006.01) |
| ***H04R 1/00*** | (2006.01) |
| ***H04R 9/06*** | (2006.01) |
| ***H04R 11/02*** | (2006.01) |
| ***H04R 11/00*** | (2006.01) |
| *H04R 9/02* | (2006.01) |

(52) U.S. Cl.

CPC ..... *H04R 1/00* (2013.01); *H04R 11/00* (2013.01); *H04R 9/025* (2013.01); *H04R 9/027* (2013.01); *H04R 2209/024* (2013.01); *H04R 2400/01* (2013.01); *H04R 2400/03* (2013.01)

(58) Field of Classification Search

CPC ..... H04R 9/025; H04R 9/027; H04R 1/00; H04R 11/00; H04R 2209/024; H04R 2400/01; H04R 2400/03

USPC ..... 381/162, 412, 417, 418

See application file for complete search history.

(56) References Cited

U.S. PATENT DOCUMENTS

2004/0258260 A1* 12/2004 Thompson et al. ..... 381/312
2011/0311093 A1* 12/2011 He ..... 381/410

* cited by examiner

*Primary Examiner* — Duc Nguyen
*Assistant Examiner* — Sean H Nguyen
(74) *Attorney, Agent, or Firm* — Peter L. Brewer; Connie Ding; Baker Donelson IP

(57) ABSTRACT

The invention provides a magnetic yoke used for a moving-iron microphone/transducer, which comprises an inner through hole, an enclosed soft magnet and two end surfaces orthogonal to the enclosed soft magnet. The magnetic yoke is one-piece configured, the outer peripheral surface of the soft magnet and the inner through hole respectively is used for connecting with an armature and a magnetic piece of the microphone/transducer, and one of the two end surfaces is used for connecting with an induction coil of the microphone/transducer, to form a vibrating/transducing drive mechanism. The manufacturing process of the magnetic yoke comprises forming a tube by drawing process and cutting the tube.

8 Claims, 3 Drawing Sheets

MAGNETIC YOKE USED FOR A MOVING-IRON MICROPHONE/TRANSDUCER

CROSS REFERENCE TO RELATED APPLICATIONS

This application is a §371 National State Application of PCT/CN2011/082135 filed Apr. 19, 2012 which claims priority to CN 201110289178.9 filed Sep. 27, 2011.

FIELD OF THE INVENTION

The invention relates to a soft magnetic device for transmitting magnetic field lines, particularly to a magnetic yoke used for a moving-iron microphone/transducer. The invention is involved in the fields of electro-acoustics, micro-mechanics as well as metal materials and processing.

DESCRIPTION OF THE RELATED ART

Currently, most of magnetic yokes used for moving-iron microphones/transducers usually are enclosed, and the edges of the each magnetic yoke may have different thickness. Thus, the conventional magnetic yokes generally can be manufactured by a lamination or casting method. For the manufacturing methods, the lamination method comprises the following steps: forming sheets comprising enclosed soft magnets and inner through holes by a punching process; and laminating the sheets by mechanical means, and then making the magnetic yokes from the laminated sheets by resistance welding; and the casting method comprises manufacturing casting molds corresponding to the desired magnetic yokes and casting the desired magnetic yokes by powder metallurgy technology. However, there are some disadvantages in the two existing methods, such as, the complicated manufacturing process, the big variation of process, as well as the high manufacturing cost. Moreover, a lot of heat resulted from the resistance welding used in the lamination method will damage the internal magnetic structure of the magnetic yokes and reduce the magnetic permeability of the magnetic yokes; and many dense air gaps will be formed in casted magnetic yokes due to the inherent characteristics of the powder metallurgy technology, this also will damage the internal magnetic structure of the magnetic yokes and reduce the magnetic permeability of the magnetic yokes. Such shortcomings in structure, cost or functionalities limit the development of moving-iron microphones/transducers, and greatly diminish the competitive advantages of them.

SUMMARY OF THE INVENTION

In order to overcome the above problem, the invention is intended to provide an improved magnetic yoke used for a moving-iron microphone/transducer. By means of the invention, the manufacturability of the magnetic yoke can be greatly improved and the manufacturing cost can be reduced. Furthermore, the magnetic circuit can be efficiently optimized and the properties of the associated microphones/transducers can be significantly improved. Additionally, the invention provides a large space of technology development and well marketing, and thus the defects in magnetic yoke of the prior art can be overcome.

For the above purpose, the following technical solutions are disclosed in the present invention:

In one aspect, the invention provides a magnetic yoke used for a moving-iron microphone/transducer, which comprises an inner through hole, an enclosed soft magnet and two end surfaces orthogonal to the enclosed soft magnet.

Especially important, the enclosed soft magnet of the magnetic yoke is one-piece configured, and each bend of edges of the enclosed soft magnet is provided with a design of chamfer adapted for process improvement.

Preferably, the magnetic yoke is made of soft magnetic alloy selected from soft iron with high magnetic permeability, A3 steel or Permalloy, in some particular applications, the magnetic yoke may be made from a ferrite material.

More preferably, the enclosed soft magnet can be made in different thickness and configurations according to the different functional requirements to form various shapes of outer peripheral surface and inner through hole, to meet the requirements in magnetic circuit design and mechanical assembly, and the shape of the configuration and inner through hole including (but not limited to) a rectangle with a design of chamfer, a square with a design of chamfer or H-shape with a design of chamfer.

In another aspect, the invention also provides a method for manufacturing the magnetic yoke for a moving-iron microphone/transducer, which comprises steps of:

drawing a soft magnetic material adapted for manufacture of the magnetic yoke to form a metal tube comprising an enclosed soft magnet and an inner through hole by adopting drawing process for metal tube; and cutting the metal tube orthogonal to the inner through hole (i.e., the direction of the end surfaces) in terms of a desired size of the magnetic yoke, to obtain the magnetic yoke.

In practice, the outer peripheral surface of the enclosed soft magnet is connected with an armature of the moving-iron microphone/transducer, the inner through hole is used for connecting with a magnetic piece of the moving-iron microphone/transducer, and one of the two end surfaces is used for connecting with an induction coil of the moving-iron microphone/transducer, to form a vibrating/transducing drive mechanism in the moving-iron microphone/transducer.

In some specific embodiments, the enclosed soft magnet is connected with the armature of the moving-iron microphone/transducer by resistance welding, laser welding, or ultrasonic welding. The inner through hole is connected with the magnetic piece of the moving-iron microphone/transducer by laser welding, ultrasonic welding or adhesive binding. And one of the two end surfaces is connected with the induction coil of the moving-iron microphone/transducer by adhesive binding.

As compared with the prior art, the present invention has the following advantages:

(1) Considering the structural defects in the existing magnetic yokes, the uniform edge width is provided in the enclosed soft magnet of the invention by using a novel manufacturing method. From this, the manufacturing process of the magnetic yoke is significantly simplified, and the manufacturing cost is greatly decreased while the production efficiency is improved.

(2) Regarding the problems arisen from inherent defects of existing lamination and casting processes, such as magnetic circuit damage and insufficient magnetic permeability, a drawing and cutting process for metal tube is utilized in the invention. Thus, the integrity of a metal material can be ensured so that the internal magnetic circuit is efficiently protected, thereby the microphones/transducers using the magnetic yoke of the invention can be significantly improved.

(3) In order to meet various functional requirements in magnetic circuit and mechanical assembly, different materials, thickness, shapes of outer peripheral surface and inner through holes can be utilized in the magnetic yoke of the invention. The available configurations includes (but not limited to) a rectangle with a design of chamfer, a square with a design of chamfer or H-shape with a design of chamfer. Furthermore, the thickness of each edge can be as small as 0.02 mm, and this cannot be achieved in a conventional process. Consequently, the invention has great application prospect.

DESCRIPTION OF THE PREFERRED EMBODIMENTS

The present invention will be described hereinafter with reference to the accompanying drawings. It is to be noted, however, that the drawings are given only for illustrative purpose and therefore not to be considered as limiting of its scope, for the invention may admit to other equally effective embodiments.

Figure 1:
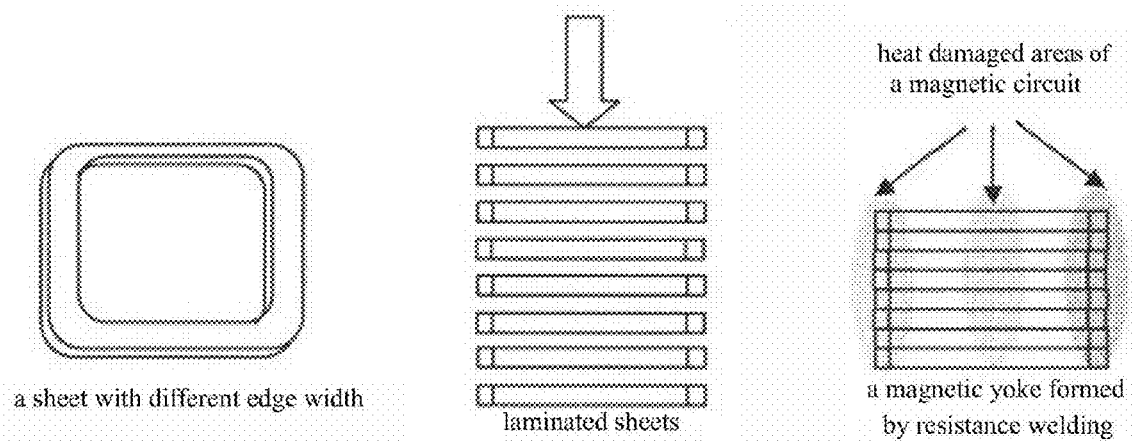
FIG. 1 is a schematic drawing showing the structure and manufacturing process of a laminated magnetic yoke in prior art.
Figure 2:
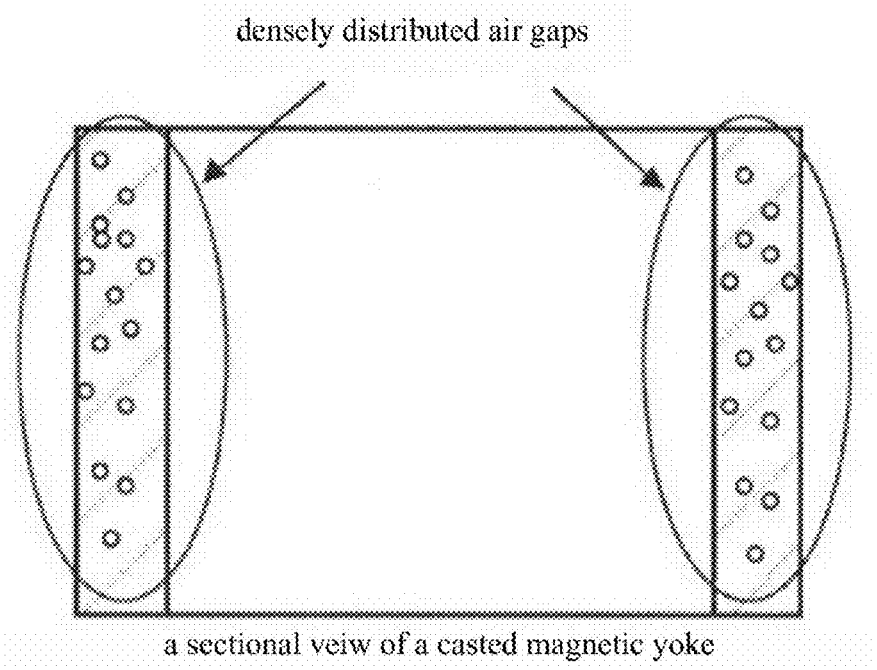
FIG. 2 is a schematic drawing showing a casted magnetic yoke in prior art.
Figure 3:
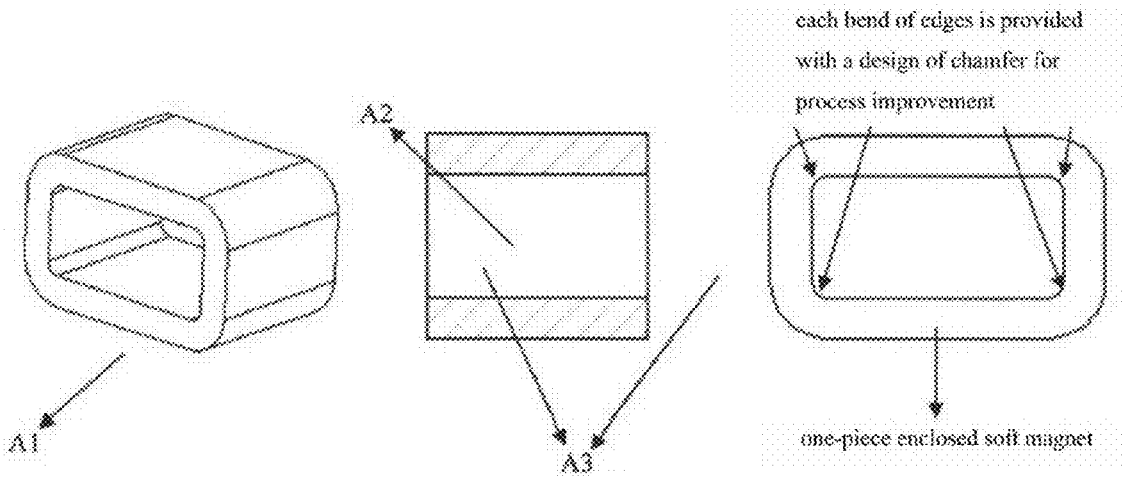
FIG. 3 is a schematic drawing showing a magnetic yoke used for a moving-iron microphone/transducer according to the invention.
Figure 4:
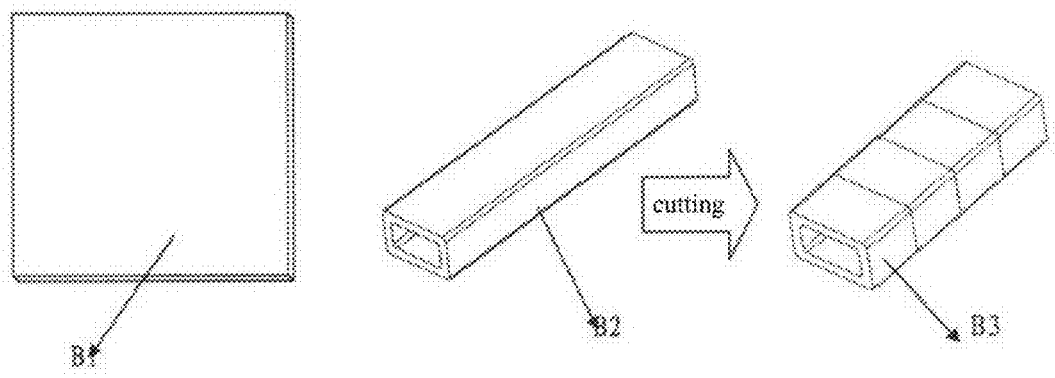
FIG. 4 is a flow chart showing the manufacturing process of the magnetic yoke used for a moving-iron microphone/transducer according to the invention.
Figure 5:
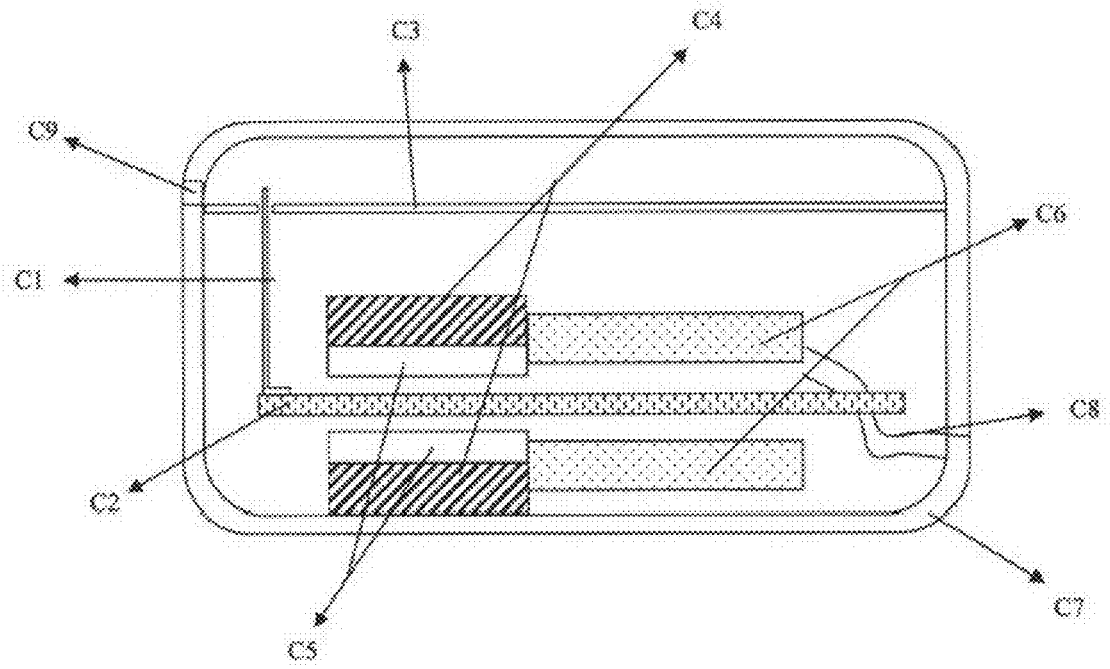
FIG. 5 is sectional view of a moving-iron microphone/transducer using the magnetic yoke of the invention.
Figure 6:
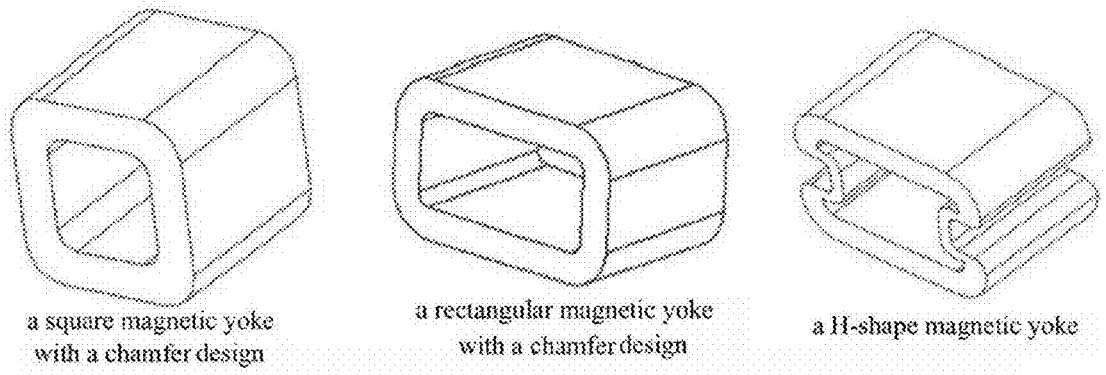
FIG. 6 is a schematic drawing showing enclosed soft magnets in different shapes of the magnetic yoke used for a moving-iron microphone/transducer according to the invention.

FIGS. 3-6 illustrate a magnetic yoke used for a moving-iron microphone/transducer, which comprises an inner through hole A2, an enclosed soft magnet A1 and two end surfaces A3 orthogonal to the enclosed soft magnet. The enclosed soft magnet is one-piece configured, and each bend of edges of the enclosed soft magnet is provided with a design of chamfer adapted for process improvement. In order to achieve the above magnetic yoke with optimized configuration, an novel manufacturing process is utilized in the embodiment, which comprises the following steps: drawing a soft magnetic material B1 adapted for manufacture of the magnetic yoke to form a metal tube B2 comprising an enclosed soft magnet A1 and an inner through hole A2 by adopting drawing process for metal tube; and cutting the metal tube B2 along a direction orthogonal to the inner through hole A2 (i.e., the direction of the end surfaces A3) in terms of a desired size of the magnetic yoke, to obtain the magnetic yoke B3.

When the magnetic yoke of the invention is specially used in a moving-iron microphone/transducer, the outer peripheral surface of the enclosed soft magnet A1 of the magnetic yoke C4 is connected with the armature C2 of the moving-iron microphone/transducer, the inner through hole A2 is used for connecting with the magnetic piece C5 of the moving-iron microphone/transducer, and one of the two end surfaces A3 is used for connecting with the induction coil C6 of the moving-iron microphone/transducer, to form a vibrating/transducing drive mechanism in the moving-iron microphone/transducer.

When the above moving-iron microphone/transducer works, an alternating current is conducted to the induction coil C6 through a signal line C8 so that an alternating magnetic field is generated due to the electromagnetic induction effect. The alternating magnetic field will magnetize the armature C2 of the vibrating/transducing drive mechanism, and then the push-pull effect will be created between the armature C2 and the magnetic piece C5 due to the principle that like poles repel, unlike poles attract, thereby a vibration conduction device C1 welded on the armature C2 will create vibration displacement along a direction perpendicular to the armature C2. When the vibration displacement is transmitted to a diaphragm C3 connected with the vibrating conduction device C1, the diaphragm C3 vibrates and further causes that its surrounding air vibrates and sounds through a sound outlet C9. From this, the transformation of electrical energy to magnetic energy and finally to mechanical energy is achieved.

Regarding to the defects on structure design of existing magnetic yokes, the invention provides an enclosed soft magnet which is one-piece configured, and a design of chamfer adapted for process improvement is provided in each bend of the edges of the enclosed soft magnet. Thus, the manufacturing process is greatly simplified, the production efficiency is improved and the manufacturing cost is significantly decreased while the functionalities are improved. Furthermore, considering the problems of magnetic circuit damage and insufficient magnetic permeability due to process defects in existing laminated and casted yoke devices, a drawing and cutting process for metal tube is utilized in the production of the magnetic yoke of the invention. From this, the integrity of a metal material is ensured in a reliable way, and the magnetic circuit is efficiently protected and the properties of the microphone/transducer using the magnetic yoke are significantly improved. Additionally, the enclosed soft magnet can be made in different thickness, configurations to form different shapes of outer peripheral surfaces and inner through holes, in order to meet the various requirements in magnetic circuit design and mechanical assembly. The available configurations includes (but not limited to) a rectangle with a design of chamfer, a square with a design of chamfer or H-shape with a design of chamfer. The thickness of each edge can be as small as 0.02 mm, and this cannot be achieved in a conventional process. Consequently, the invention has a large space of technology development and well marketing and thus has great application prospect.

As described above, the detailed description is illustrated according to the spirit of the invention, but the invention is not limited to the aforementioned embodiments and implementing methods. Many variations and implements can be made within the scope of the invention by those skilled in the related art.

What is claimed is:

1. A magnetic yoke used for a moving-iron microphone/transducer, comprising an inner through hole, an enclosed soft magnet and two end surfaces orthogonal to the enclosed soft magnet, wherein:

an outer peripheral surface of the enclosed soft magnet is connected with an armature of the moving-iron microphone/transducer, the inner through hole is configured to connect with a magnetic piece of the moving-iron microphone/transducer, and one of the two end surfaces is connected with an induction coil of the moving-iron microphone/transducer to form a vibrating/transducing drive mechanism;

the outer peripheral surface of the enclosed soft magnet is connected with the armature of the moving-iron microphone/transducer by resistance welding, laser welding, or ultrasonic welding; and the magnetic yoke comprises a closed, polygonal, cross-sectional profile having chamfers along each connecting vertex.

2. The magnetic yoke of claim 1, wherein the inner through hole is connected with the magnetic piece of the moving-iron microphone/transducer by laser welding, ultrasonic welding or adhesive binding.

3. The magnetic yoke of claim 1, wherein one of the two end surfaces is connected with the induction coil of the moving-iron microphone/transducer by adhesive binding.

4. The magnetic yoke of claim 1, wherein the enclosed soft magnet comprises one-integral piece.

5. The magnetic yoke of claim 1, wherein the magnetic yoke is made of soft magnetic alloy selected from soft iron with high magnetic permeability, A3 steel, Permalloy, or a ferrite material.

6. The magnetic yoke of claim 1, wherein:

the cross-sectional profile of the magnetic yoke is a rectangle, a square or an H-shape; and the outer peripheral surface has a uniform width.

7. The magnetic yoke of claim 1, wherein the magnetic yoke is manufactured by steps comprising:

drawing a soft magnetic material to form a metal tube comprising the enclosed soft magnet and the inner through hole; and cutting the metal tube along a direction orthogonal to the inner through hole to form the end surfaces according to a desired size of the magnetic yoke.

8. A moving-iron microphone/transducer as claimed in claim 1, wherein the microphone/transducer uses the magnetic yoke which is connected with an armature of the moving-iron microphone/transducer by the outer peripheral surface of the enclosed soft magnet, the inner through hole being connected with the magnetic piece, and one of the two end surfaces being connected with an induction coil of the moving-iron microphone/transducer, to form the vibrating/transducing drive mechanism in the moving-iron microphone/transducer, wherein:

when an alternating current flows through the induction coil to generate an alternating magnetic field due to an electromagnetic induction effect, the armature in the vibrating/transducing drive mechanism is magnetized and a push-pull effect is created between the armature and the magnetic piece due to the principle that like poles repel, unlike poles attract, thereby causing a vibration displacement of a vibration conduction device welded on the armature along a direction perpendicular to the armature, and when the vibration displacement is transmitted to a diaphragm connected with the vibrating conduction device, the diaphragm vibrates and further makes its surrounding air vibrate and sound, thereby achieving a transformation of electrical energy to magnetic energy and then to mechanical energy.

* * * * *